United States Patent [19]

Tikhonov et al.

[11] 4,245,459

[45] Jan. 20, 1981

[54] SPINNING CHAMBER OF APPARATUS FOR OPEN-END SPINNING

[76] Inventors: Valentin N. Tikhonov, ulitsa Sh. Rustaveli, 55, kv. 28; Gennady N. Shlykov, Chilanzar, kvartal 19, 31, kv. 3; Vitaly I. Zhestkov, Chilanzar, kvartal 19, 26, kv. 41; Gennady V. Zhigalov, ulitsa B. Khmelnitskogo, korpus 2, 69, kv. 6; Viktor M. Mukhin, ulitsa B. Khmelnitskogo, korpus 5, 69, kv. 31; Vasily M. Dyachkov, Chilanzar, kvartal 7, 18 "V", kv. 8, all of Tashkent, U.S.S.R.

[21] Appl. No.: 13,131

[22] Filed: Feb. 21, 1979

[51] Int. Cl.[3] ..... D01H 7/885

[52] U.S. Cl. ..... 57/58.89; 57/302

[58] Field of Search ..... 57/58.89, 300, 301, 57/302

[56] References Cited

U.S. PATENT DOCUMENTS

| | | | |
|---|---|---|---|
| 3,605,395 | 9/1971 | Morikawa et al. | 57/58.89 |
| 3,796,034 | 3/1974 | Grau | 57/58.89 X |
| 3,859,779 | 1/1975 | Furstenberg | 57/302 X |
| 3,994,120 | 11/1976 | Radom et al. | 57/58.89 |

FOREIGN PATENT DOCUMENTS

| | | | |
|---|---|---|---|
| 58538 | 5/1976 | Japan | 57/58.89 |

*Primary Examiner*—Donald Watkins

*Attorney, Agent, or Firm*—Lackenbach, Lilling & Siegel

[57] ABSTRACT

The present invention relates to spinning chambers of an apparatus for open-end spinning, which can be most effectively realized for producing yarns of low linear densities. This chamber comprises a housing shaped as a truncated cone with a larger open base and via this open end-face elimination of impurities from the yarn is performed.

3 Claims, 3 Drawing Figures

SPINNING CHAMBER OF APPARATUS FOR OPEN-END SPINNING

FIELD OF THE INVENTION

The present invention relates to the textile machine-building industry and, more particularly, to rotor spinning machines, wherein a working organ which forms a yarn is a spinning chamber.

The present invention can be most effectively realized in rotor spinning machines producing yarns of low linear densities at high speeds of rotation of the chamber.

BACKGROUND OF THE INVENTION

At present, there are known various structures of spinning chambers having an inner cavity formed by two conical surfaces facing each other at the junction of which is a collecting trough-like groove (cf. Japanese Pat. No. 5035569, cl. 43 B22).

This chamber is disadvantageous in that the lint detached from the introduced fibers under the action of the centrifugal force builds up on the yarn formed in the trough-like groove and forms slubs in the yarn, thereby impairing the yarn quality and causing downtimes thereof and breakdowns.

This disadvantage is obviated in a spinning chamber according to USSR Inventor's Certificate No. 211371, Cl. 71c, 24/01, wherein a sectional trough-like groove is made on a working surface representing a truncated cone. This allows one to separate a cavity where fibers are fed from a cavity wherein a yarn is formed with a subsequent removal of detached lint and trash by sucking air through special passageways.

One of the bases of the truncated cone is closed, and the lint and trash are exhausted due to the rarefaction created on the side of this closed base through special passageways interconnected by lands.

However, the disadvantage of this chamber consists in that on the lands between the passageways, there are always portions wherein the streams of air sucked into the adjacent passageways balance one another, thereby forming the so-called "dead zone", wherein the removed lint and trash are not subjected to the action of the air underpressure and these impurities lodge on the lands under the action of the centrifugal force. As a result, these placed are responsible for the lint accumulations which are liable, due to build-up, to a choke the passageways thus disturbing the chamber operation. This causes one periodically to stop it from time to time with the aim of cleaning and eliminating the impurities, whereby productivity of the spinning frame is reduced and the servicing thereof complicated.

BRIEF DESCRIPTION OF THE INVENTION

It is an object of the present invention to provide a spinning chamber which will increase productivity.

Another object of the present invention is to provide a spinning chamber which will enhance the quality of the produced yarn.

Yet another object of the present invention is to provide a spinning chamber which will simplify the structure of the spinning apparatus in its entirety.

These and other objects are attained by a spinning chamber comprising a rotatably installed housing shaped as a truncated cone and on an inner surface of which there is made an annular trough-like groove for the formation of fibrous bands. The housing, on the side of a larger base of the cone, is made open. The invention also relates to a method of cleaning the yarn in the proposed chamber. The suction or rarefaction is set up on the side of the open larger base of the cone and through this base impurities are removed from the yarn. Such a structure of the chamber increases machine productivity and facilitates servicing thereof since the open end-face of the truncated cone allows the impurities both rather small (lint) and fairly large to slip over the inner conical surface towards the larger open base where the underpressure is set up. Due to this underpressure all impurities are dragged into trash collectors and removed from the zone of yarn formation.

Thus, machine downtimes for removal of impurities from the chamber, as was the case with the chambers of known structures, are avoided.

Besides, in the presently disclosed chamber, due to structural peculiarities, the zone of yarn formation is separated from the zone of trash removal, whereby the adhesion and accumulation of trash apt to form slubs in the fibrous band in the course of yarn formation are prevented. This to a considerable degree enhances the quality of the produced yarn and decreases the downtimes thereof.

Taking into consideration the fact that the impurities are caused centrifugally to slip over the inner surface of the truncated cone, it is required to set up the suction or rarefaction sufficient for sucking mainly at the periphery of the chamber housing. With this aim in view, in the chamber, it is necessary to place, on the side of the larger open base, a conical disk arranged concentrically with the chamber housing and with a clearance between an outer conical surface thereof and the inner surface of the housing.

Such an arrangement of the disk makes it possible to increase the effect of rarefaction (suction) by reducing the clear opening for the sucked air stream, whereas the concentric clearance prevents accumulation of lint and trash.

To solve the problem of increasing the machine productivity and simplifying the service thereof, it is required to transfer the removed impurities to a centralized suction system for which the effect of ventilation in the clear opening for the air being exhausted should be improved. For this, according to the invention, provided on the outer conical surface of the disk, at an angle to the generatrix, are ribs which form stream of the air let out in the direction of sucking and which add to the efficiency thereof.

BRIEF DESCRIPTION OF THE DRAWINGS

Given below is a detailed description of the invention with reference to the accompanying drawings, wherein.

DETAILED DESCRIPTION OF THE INVENTION

Figure 1:
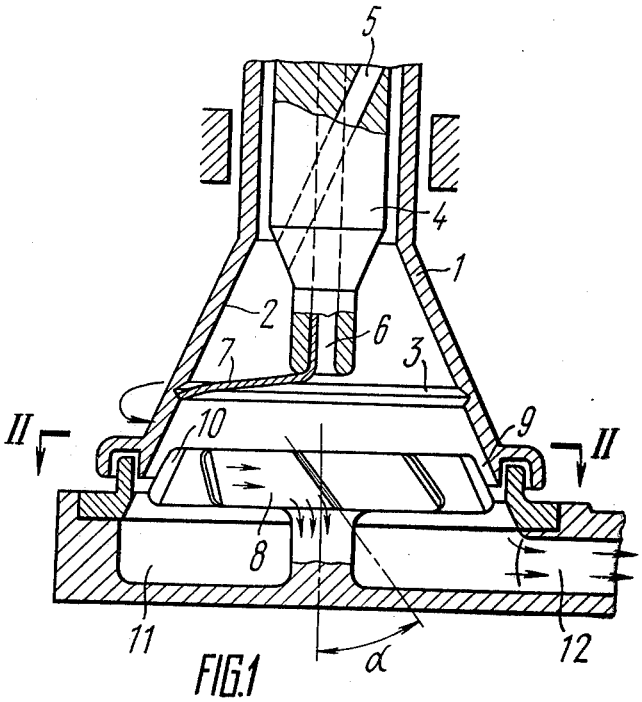
FIG. 1 is a longitudinal sectional view of a spinning chamber according to the invention.

The spinning chamber includes a housing 1 (FIG. 1) rotatably mounted and shaped as a truncated cone with an inner surface 2 whereon an annular trough-like groove 3 is made. The chamber receives a bush 4 with a passageway 5 letting in disintegrated fibers and with a passageway 6 letting out a yarn 7. The larger base of the cone is made open and on the side thereof is placed a conical disk 8 installed concentrically with the housing and with a clearance 9 between the outer surface thereof and the inner surface of the housing.

Figure 2:
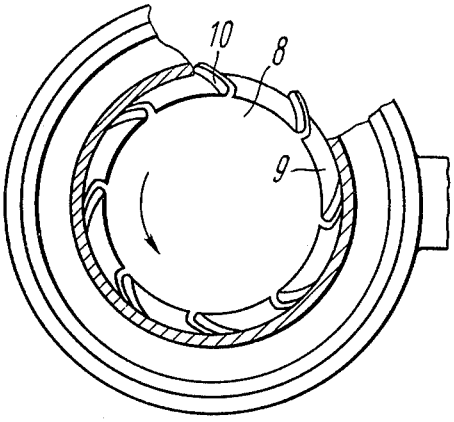
FIG. 2 is a sectional view, partially broken away, and taken along line II—II of FIG. 1.

Placed in the clearance 9, on the disk 8, at an angle $\alpha$ to the generatrix, are ribs 10 with their bottom portion arranged in the direction of rotation of the chamber as is seen in FIG. 2. The cone of the chamber on the side of the larger base changes into a cavity 11 (FIG. 1) communicating with a passageway 12 for sucking air and removing impurities.

The spinning chamber operates as follows.

Conveyed along the passageway 5 is a stream of separate fibers which, upon getting on the inner surface 2 of the housing 1, transfer centrifugally towards the annular trough-like groove 3.

While being condensed in the groove 3, the fibers form a fibrous band which, with the housing 1 rotating, is twisted into the yarn 7 delivered through the passageway 6 of the bush 4.

The lint and trash detached in the process of quantification under the action of the aerodynamic and centrifugal force are thrown to the larger base of the truncated cone which is made open. The developed rarefaction enables, with the aid of the conical disk 8, to increase the speed of suction of the impurities in the zone of the clearance 9. To direct the impurities to the centralized suction system and to enhance the effect of ventilation, the disk 8 is provided with the ribs 10 which guide the impurities through the cavity 11 into the passageway 12.

Figure 3:
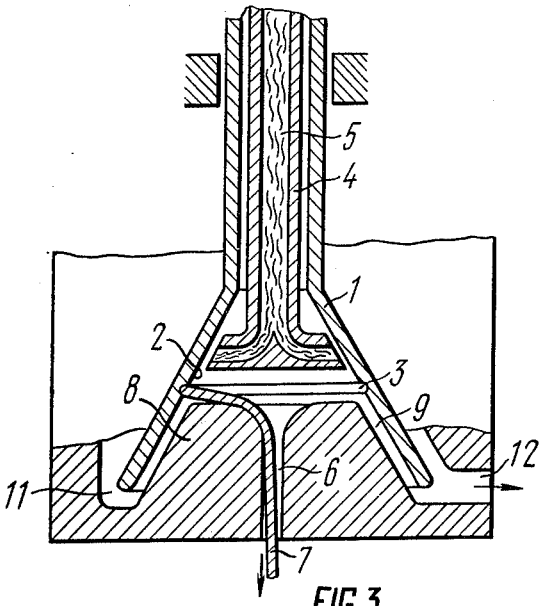
FIG. 3 is another longitudinal sectional view of an alternative embodiment of the chamber, wherein the fibers are let in and the yarn is let out in opposite directions.

The delivery of the new-spun yarn 7 may be effected either in the direction of advance of the stream of separate fibers or in the opposite direction as shown in FIG. 3, i.e. the passageway 5 introducing fibers and the passageways 6 discharging the yarn 7 extend in opposite directions.

Although the present invention has been described in some detail by way of illustration and example for purposes of clarity of understanding, it will, of course, be understood that various changes and modifications may be made in the form, details, and arrangements of the parts without departing from the scope of the invention as set forth in the following claims.

What is claimed is:

1. A spinning chamber of an apparatus for open-end spinning, comprising: a rotatable housing shaped as a truncated cone and having an annular trough-like groove in the chamber of said housing on an inner surface thereof and intended for the formation of yarn from a stream of disintegrated fibers fed into the rotatable housing, said housing being opened on the side of a larger base of the truncated cone; and at the periphery of the rotatable housing a conical disc is placed on the side of the larger base concentrically with the inner surface of said rotatable housing and with a clearance between an outer conical surface of said disc and the inner surface of said rotatable housing; whereby dust and other fiber debris is eliminated from said chamber due to the intensified flow between the inner surface of said housing and the outer conical surface of said disc.

2. A chamber as claimed in claim 1, wherein ribs are provided on the outer conical surface of said disc at an angle to the generatrix.

3. A chamber as claimed in claim 1, wherein said conical disc extends substantially into the open side of the larger base of said truncated cone forming an annular clearance passageway therebetween, thereby increasing the suction effect and precluding the accumulation of lint and other debris within the chamber of said rotatable housing.

* * * * *